US006575384B2

(12) United States Patent
Ricco

(10) Patent No.: US 6,575,384 B2
(45) Date of Patent: Jun. 10, 2003

(54) FUEL INJECTOR WITH A CONTROL ROD CONTROLLED BY THE FUEL PRESSURE IN A CONTROL CHAMBER

(75) Inventor: Mario Ricco, Casamassima (IT)

(73) Assignee: C.R.F. Societa Consortile per Azioni, Strada Torino (IT)

( * ) Notice: Subject to any disclaimer, the term of this patent is extended or adjusted under 35 U.S.C. 154(b) by 147 days.

(21) Appl. No.: 09/814,239

(22) Filed: Mar. 21, 2001

(65) Prior Publication Data

US 2001/0054651 A1 Dec. 27, 2001

(30) Foreign Application Priority Data

Mar. 21, 2000 (IT) ..... TO2000A0268

(51) Int. Cl.[7] ..... F02M 47/02; F02M 59/00; B05B 1/00

(52) U.S. Cl. ..... 239/88; 239/91; 239/92; 239/533.2; 239/585.1; 239/585.4; 239/585.5

(58) Field of Search ..... 239/88, 91, 92, 239/95, 533.2, 533.3, 533.9, 585.1, 585.4, 585.5, 900, 5; 123/446, 447, 496

(56) References Cited

U.S. PATENT DOCUMENTS 5,148,987 A 9/1992 Taue ..... 239/96
5,682,858 A * 11/1997 Chen et al. ..... 123/467
5,709,194 A 1/1998 Moncelle ..... 123/446
6,053,421 A * 4/2000 Chockley ..... 239/5
6,065,450 A * 5/2000 Chen et al. ..... 123/446
6,082,332 A * 7/2000 Hefler et al. ..... 123/446

FOREIGN PATENT DOCUMENTS

EP 0 753 659 A1 1/1997

* cited by examiner

*Primary Examiner*—Michael Mar
*Assistant Examiner*—Davis Hwu
(74) *Attorney, Agent, or Firm*—Pennie & Edmonds LLP

(57) ABSTRACT

The injector has a control rod controlled by the fuel pressure in a control chamber, and a nozzle having an injection chamber supplied with pressurized fuel for injection. The nozzle has at least one injection orifice normally closed by a pin connected to the rod and activated by the fuel pressure in the injection chamber. The control chamber has a pressurized-fuel intake conduit, and a fuel discharge conduit which is normally closed and is opened for a variable length of time depending on the amount of fuel to be injected. The pin and the rod, and/or the intake conduit and the discharge conduit, are so sized as to keep the pin and the rod hydraulically balanced in the maximum-lift position to open the orifice.

6 Claims, 2 Drawing Sheets

FUEL INJECTOR WITH A CONTROL ROD CONTROLLED BY THE FUEL PRESSURE IN A CONTROL CHAMBER

The present invention relates to a fuel injector, in particular for an internal combustion engine, with a control rod controlled by the fuel pressure in a control chamber.

BACKGROUND OF THE INVENTION

Known fuel injectors normally comprise a nozzle having an injection chamber supplied with pressurized fuel for injection; the nozzle has injection orifices which are normally closed by a pin connected to the control rod and activated by the fuel pressure in the injection chamber; and the control chamber has a calibrated fuel intake conduit, and a calibrated, normally-closed control chamber discharge conduit controlled by a metering valve in turn controlled by an electromagnet, which is energized for a variable length of time depending on the amount of fuel for injection.

In known injectors, the control rod is normally arrested mechanically by a fixed stop after sufficient travel to open the nozzle orifices and before fuel injection is completed. The rod is normally arrested by the end wall of the cylindrical rod guide, but, to eliminate precision machining of the end wall of the rod guide, the rod of one known injector is provided with an annular shoulder which is arrested against the edge of the cylindrical guide carried by the usual metering valve body.

In both the above cases, mechanical arrest poses various drawbacks. In particular, it causes a certain amount of shock-induced wear; and, to obtain a predetermined travel, both the fixed stop member and the arrested rod member involve precision machining, complex assembly work, and various provisions to ensure fluidtight sealing between the rod and guide.

SUMMARY OF THE INVENTION

It is an object of the present invention to provide a fuel injector of the above type, which is cheap to produce, highly reliable, and provides for eliminating the aforementioned drawbacks typically associated with known injectors.

According to the present invention, there is provided a fuel injector for an internal combustion engine, the injector having a control rod controlled by the fuel pressure in a control chamber, and comprising a nozzle having an injection chamber supplied with pressurized fuel for injection; said nozzle having at least one injection orifice normally closed by a pin; said pin being connected to said rod and being activated by the fuel pressure in said injection chamber; said control chamber having a pressurized-fuel intake conduit and a fuel discharge conduit; said discharge conduit being normally closed and being opened for a variable length of time; and the injector being characterized in that said pin and said rod, and/or said intake conduit and said discharge conduit, are so sized as to keep said pin and said rod hydraulically balanced in a maximum-lift position to open said orifice.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
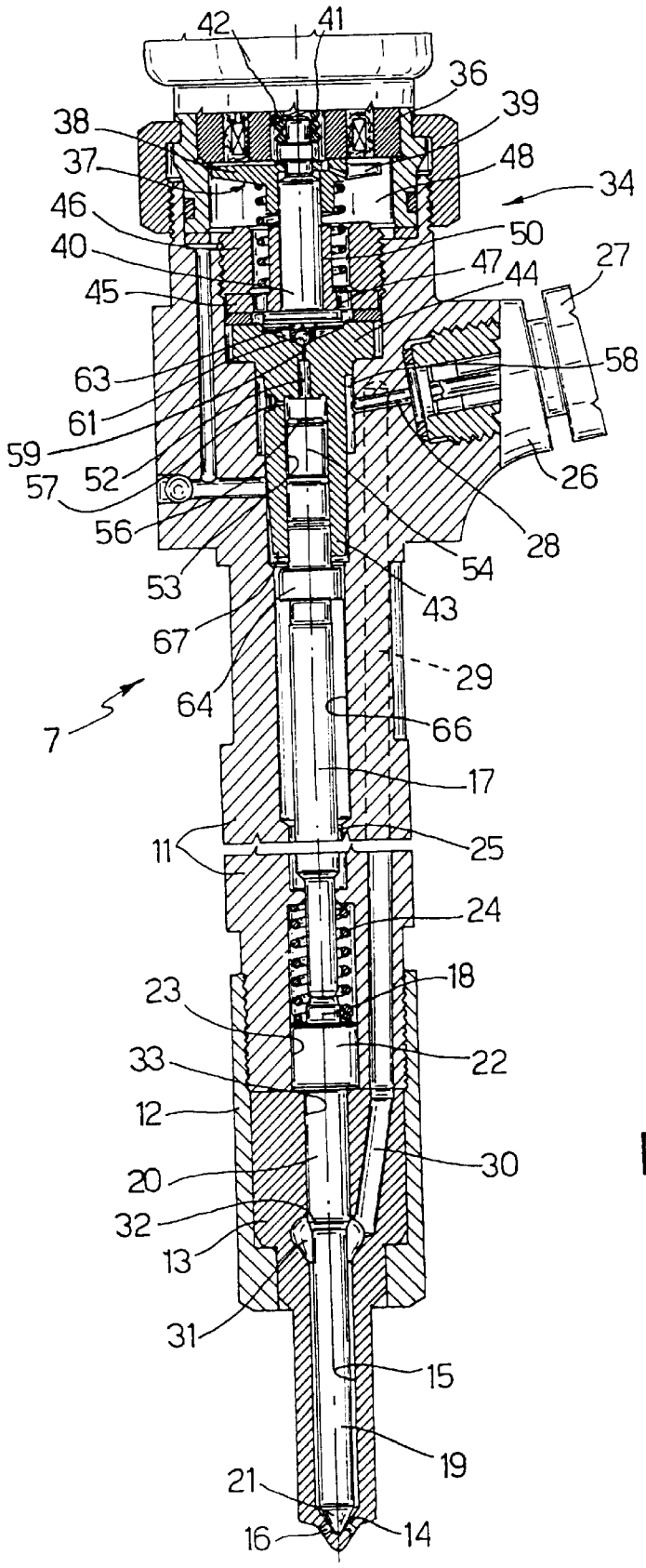
FIG. 1 shows a half section of an internal combustion engine fuel injector in accordance with the present invention.

Number 7 in FIG. 1 indicates as a whole a fuel injector for an internal combustion, e.g. diesel, engine. Injector 7 comprises a hollow body 11 connected by a ring nut 12 to a nozzle 13; nozzle 13 has an axial hole 15 and terminates with a conical seat 14 (see also FIG. 2) having injection orifices 16; and body 11 has an axial hole 25 in which slides a control rod 17.

Hollow body 11 also has an appendix 26 in which is inserted an intake fitting 27 connected to a pressurized-fuel supply conduit. Appendix 26 has a hole 28, which, via a feed conduit 29 in body 11 and a feed conduit 30 in nozzle 13, communicates with an annular injection chamber 31 formed in nozzle 13 and communicating with axial hole 15.

One end of rod 17 engages an appendix 18 of a pin 19 for closing orifices 16 and which slides inside axial hole 15. More specifically, pin 19 has a conical end 21 engaging conical seat 14 of nozzle 13, and comprises a portion 20 guided in fluidtight manner inside a portion 33 of hole 15 in nozzle 13.

Portion 20 terminates at one end with a collar 22 supporting appendix 18 and guided inside a cylindrical seat 23 in body 11; collar 22 is normally pushed towards seat 14 by a spring 24 which helps to keep orifices 16 closed; and, at the other end, portion 20 terminates with a shoulder 32 on which the pressurized fuel in chamber 31 acts.

With respect to the inner wall of hole 15 in nozzle 13, pin 19 has a given clearance to ensure fast fuel flow from chamber 31 to orifices 16 of nozzle 13. In known injectors, the volume of chamber 31 is normally less than the maximum amount of fuel to be injected by injector 7, so that feed conduits 29 and 30 are sized to also permit fuel supply to chamber 31 during injection.

Injector 7 also comprises a metering valve indicated as a whole by 34 and which is activated by an electromagnet 36 controlling an armature 37. Armature 37 comprises a disk 38 having slits 39 and connected to a stem 40, which is pushed downwards by a compression spring 41 housed in a central hole 42 in electromagnet 36.

Metering valve 34 comprises a body 43 having a flange 44 normally held resting on a shoulder of body 11 of injector 7 by a ring nut 46 and by means of a flange 45 of a guide 50 for guiding stem 40. Flange 45 has holes 47 communicating with a discharge chamber 48 of metering valve 34; and, via slits 39 in disk 38 and central hole 42, discharge chamber 48 communicates with a discharge fitting (not shown in FIG. 1) communicating with the fuel tank.

Body 43 of metering valve 34 has an axial control chamber 52 (see also FIG. 3) communicating with a guide cylinder 53 in body 43 of valve 34. A piston-shaped portion 54 of rod 17 slides in fluidtight manner inside cylinder 53, which terminates with an end wall 55 adjacent to an end surface 56 of portion 54 of rod 17.

Body 43 comprises a calibrated radial fuel intake conduit 57 communicating with hole 28 in appendix 26 via an annular groove 58; and a calibrated axial discharge conduit 59 for discharging the fuel from control chamber 52 and communicating with discharge chamber 48.

Rod 17 has a collar 64 housed in a larger-diameter portion 66 of hole 25. Collar 64 is locked by valve body 43 inside portion 66 of hole 25, and cooperates with an edge 67 of valve body 43 to prevent surface 56 contacting end wall 55 of cylinder 53.

The pressurized fuel in control chamber 52 acts on end surface 56 of portion 54 of rod 17; and, since surface 56 of rod 17 has a greater area than shoulder 32, the fuel pressure, with the aid of spring 24, normally keeps rod 17 in the lowered position with end 21 of pin 19 contacting conical seat 14 of nozzle 13 to close injection orifices 16.

Discharge conduit 59 of control chamber 52 is normally closed by a plug in the form of a ball 61, which rests on a contact surface of a conical surface 62 of flange 44, at which discharge conduit 59 terminates. Ball 61 is engaged by a guide plate 63 on which stem 40 of armature 37 acts.

When electromagnet 36 is energized, armature 37 moves stem 40 in opposition to spring 41; and the fuel pressure in control chamber 52 releases ball 61 to discharge the fuel from chamber 52 into discharge chamber 48 and back into the tank. Intake conduit 57 is, obviously, unable to restore the pressure in chamber 52, and the fuel pressure in injection chamber 31 overcomes the residual pressure on end surface 56 of rod 17 to raise pin 19, so that the fuel in chamber 31 is injected through orifices 16.

When electromagnet 36 is deenergized, spring 41 clicks down stem 40 together with armature 37. Stem 40 also restores ball 61 to the closed position closing discharge conduit 59, and the pressurized fuel restores the pressure in control chamber 52 so that pin 19 closes orifices 16.

Figure 3:
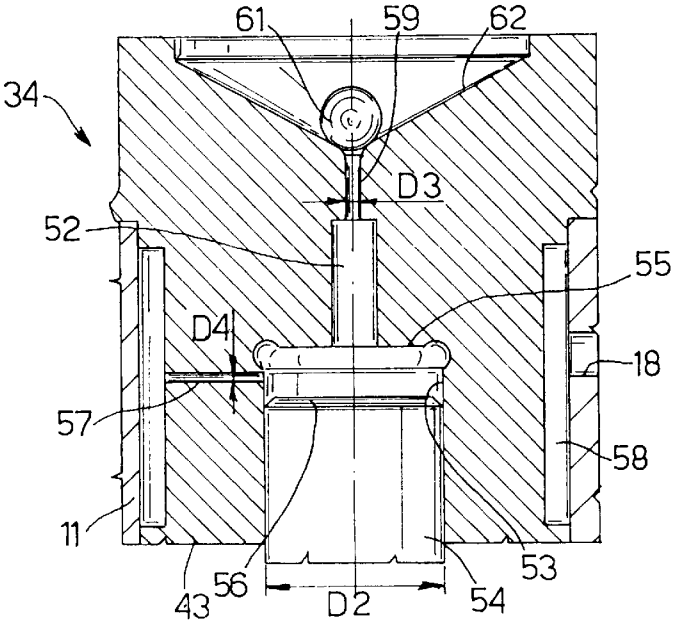
FIG. 3 shows another larger-scale detail of FIG. 1.
Figure 2:
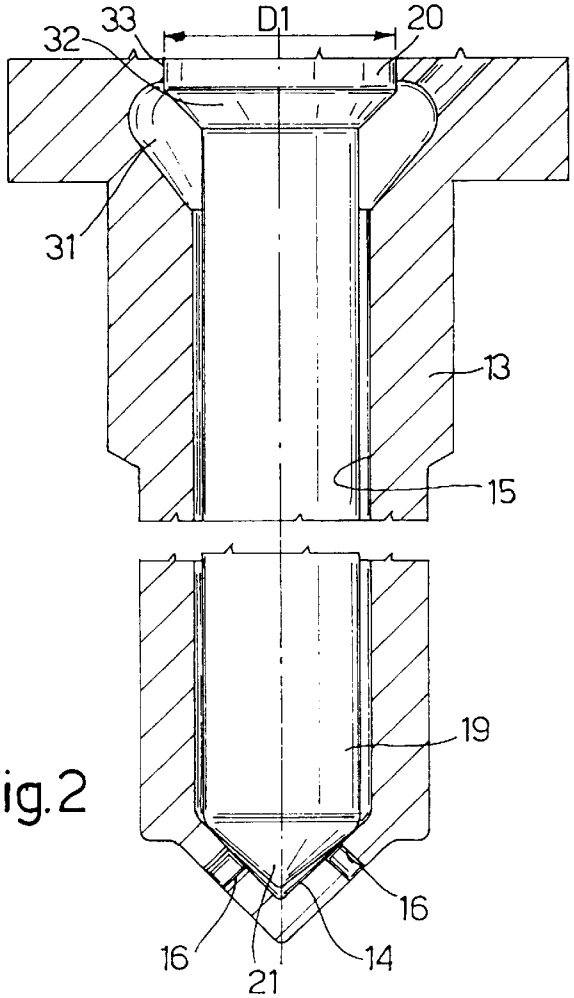
FIG. 2 shows a larger-scale detail of FIG. 1.

According to the invention, injector 7 is so sized that rod 17 and pin 19 are moved from the position closing nozzle 13 (as shown in FIGS. 1–3) and are maintained hydraulically balanced in a position opening orifices 16 and constituting the maximum actual lift of rod 17 and pin 19. This is achieved by appropriately sizing pin 19 and rod 17, and/or intake conduit 57 and discharge conduit 59.

Advantageously, hydraulic balance of rod 17 and pin 19 may be achieved by selecting a 3 to 5 mm diameter DI for portion 20 of pin 19, and necessarily the same or a larger diameter D2, e.g. 3 to 6.5 mm, for portion 54 of rod 17. With a spring 24 exerting a predetermined force on pin 19, and with a predetermined fuel pressure in chamber 31 during injection, the ratio D2/D1 between diameter D2 of portion 54 of rod 17 and diameter D1 of portion 20 of pin 19 may range between 1 and 1.3.

Alternatively, when metering valve 34 is open, fuel flow in control chamber 52 may be such as to keep control chamber 52 at a given pressure and, with the aid of spring 24, balance the fuel pressure on shoulder 32 of pin 19. For which purpose, diameter D3 of discharge conduit 59 may advantageously range between 0.2 and 0.4 mm. Alternatively, conduit 59 may be defined by multiple holes, the total area of which must equal the section area of conduit 59.

With a spring 24 exerting a predetermined force on pin 19, and with a predetermined incoming fuel pressure into control chamber 52, the ratio D3/D4 between diameter D3 of discharge conduit 59 and diameter D4 of intake conduit 57 may range between 0.8 and 1.5. Obviously, both ratio D2/D1 between the diameters of portions 54 and 20 and ratio D3/D4 between the diameters of conduits 59 and 57 may be selected accordingly.

If to (FIG. 4) is the instant at which electromagnet 36 is energized, injection commences at instant t1 with a predetermined delay or offset with respect to instant to. Rod 17 (see also FIGS. 1 and 3) is arrested hydraulically at instant t2, when the forces acting on the rod 17-pin 19 assembly reach a state of balance, and travel of the rod depends on both ratio D2/D1 between the diameters of portions 54 and 20, and ratio D3/D4 between the diameters of discharge and intake conduits 59 and 57. This position of rod 17 substantially corresponds to end 21 of pin 19 fully opening orifices 16.

The length of time electromagnet 36 is energized may be less than or greater then time interval t2-t0. If less than interval t2-t0, the amount of fuel Q injected, from the start of the opening stroke to the end of the corresponding closing stroke of rod 17 and pin 19, increases substantially steadily from the duration ending at instant t1 to the duration ending at instant t2, as shown by a first graph segment 68 indicated by the continuous line in FIG. 4, and which is therefore straight and slopes at a given angle with respect to the x axis.

If the length of time electromagnet 36 is energized terminates after instant t2, the increase in the amount of fuel Q injected decreases, as shown by the less steeply inclined graph segment 69, to form a knee P at the duration terminating at instant t2 at which rod 17 is arrested. Segment 69 extends up to a point F, which defines the total amount of fuel injected and corresponds to a duration ending at instant t3.

Figure 4:
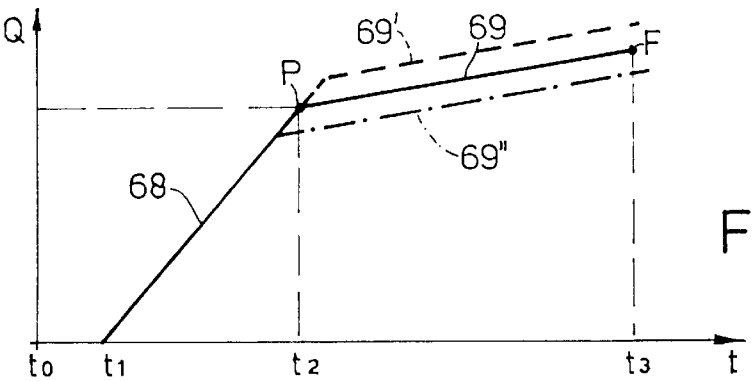
FIG. 4 shows a flow graph of the injector.

Any tolerances in diameters D1–D4 shift knee P along segment 68, and so shift segment 69 parallel to itself. In FIG. 4, the dash-line segment 69' represents the situation in which rod 17 travels past the segment 69 position, and the dash-and-dot-line segment 69" the situation in which rod 17 is arrested before the segment 69 position.

The advantages, with respect to known technology, of injector 7 according to the invention will be clear from the foregoing description. In particular, rod 17 undergoes no impact, each time the injector is activated, thus reducing wear and deformation; neither the arrested collar 64 nor edge 67 of valve body 43 need precision machining; and any difficulty involved in assembling and adjusting the travel of rod 17 is eliminated.

Clearly, changes may be made to the injector as described herein without, however, departing from the scope of the accompanying Claims. For example, intake conduit 57 may be located at control chamber 52 as opposed to cylinder 53.

Moreover, the travel of pin 19 and rod 17 may be limited mechanically in any way other than the one described. For example, the travel of pin 19, as opposed to collar 64 of rod 17, may be limited in the same way.

What is claimed is:

1. A fuel injector having a control rod controlled by the fuel pressure in a control chamber, and comprising a nozzle having an injection chamber supplied with pressurized fuel for injection; said nozzle having at least one injection orifice normally closed by a pin; said pin being connected to said rod and being activated by the fuel pressure in said injection chamber; said control chamber having a pressurized-fuel intake conduit and a fuel discharge conduit; said discharge conduit being normally closed and being opened for a variable length of time;

wherein said pin and said rod, and/or said intake conduit and said discharge conduit, are so sized as to keep said pin and said rod hydraulically balanced in a maximum-lift position to open said orifice.

2. An injector as claimed in claim 1, wherein said pin comprises a portion on which the fuel pressure in said injection chamber acts; and wherein said rod comprises a portion on which the fuel pressure in said control chamber acts; said portion of said rod having a corresponding diameter; wherein the diameter of said portion of said pin ranges between 3 and 5 mm; and the ratio between the diameter of said portion of said rod and the diameter of said portion of said pin ranges between 1 and 1.3.

3. An injector as claimed in claim 1, wherein said discharge conduit has a diameter, and said intake conduit has a corresponding diameter; wherein the ratio between the diameter of said discharge conduit and the diameter of said intake conduit ranges between 0.8 and 1.5.

4. An injector as claimed in claim 3, characterized in that the diameter of said discharge conduit (59) ranges between 0.2 and 0.4 mm.

5. A fuel injector comprising:

a control rod controlled by the fuel pressure in a control chamber, said control chamber having a pressurized-fuel intake conduit and a fuel discharge conduit; said discharge conduit being normally closed and being opened for a variable length of time, wherein said rod comprises a portion on which the fuel pressure in said control chamber acts, said portion of said rod having a diameter; and a nozzle having an injection chamber supplied with pressurized fuel for injection, said nozzle having at least one injection orifice normally closed by a pin, said pin comprises a portion on which the fuel pressure in said injection chamber acts, the diameter of said portion of said pin ranges between about 3 mm and about 5 mm;

wherein said pin being connected to said rod and activated by the fuel pressure in said injection chamber;

wherein said pin and said rod, and/or said intake conduit and said discharge conduit, are so sized as to keep said pin and said rod hydraulically balanced in a maximum-lift position to open said orifice;

wherein the ratio between the diameter of said portion of said rod and the diameter of said portion of said pin ranges between about 1 and about 1.3.

6. A fuel injector comprising:

a control rod controlled by the fuel pressure in a control chamber, said control chamber having a pressurized-fuel intake conduit and a fuel discharge conduit, said discharge conduit being normally closed and being opened for a variable length of time, said discharge conduit having a diameter; said intake conduit having a corresponding diameter, the ratio between the diameter of said discharge conduit and the diameter of said intake conduit ranging between about 0.8 and about 1.5; and a nozzle having an injection chamber supplied with pressurized fuel for injection, said nozzle having at least one injection orifice normally closed by a pin;

wherein said pin is connected to said rod and activated by the fuel pressure in said injection chamber; and wherein said pin and said rod, and/or said intake conduit and said discharge conduit, are so sized as to keep said pin and said rod hydraulically balanced in a maximum-lift position to open said orifice.

* * * * *